US006636194B2

(12) United States Patent
Ishii

(10) Patent No.: US 6,636,194 B2
(45) **Date of Patent: *Oct. 21, 2003**

(54) ELECTROOPTIC DEVICE AND ELECTRONIC EQUIPMENT

(75) Inventor: Ryo Ishii, Suwa (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/509,942

(22) PCT Filed: Aug. 2, 1999

(86) PCT No.: PCT/JP99/04174

§ 371 (c)(1),
(2), (4) Date: Apr. 4, 2000

(87) PCT Pub. No.: WO00/08625

PCT Pub. Date: Feb. 17, 2000

(65) Prior Publication Data

US 2003/0151582 A1 Aug. 14, 2003

(30) Foreign Application Priority Data

Aug. 4, 1998 (JP) ..... 10-220737
Sep. 9, 1998 (JP) ..... 10-255849

(51) Int. Cl.[7] ..... G09G 3/36

(52) U.S. Cl. ..... 345/98; 345/89; 345/90; 345/91; 345/92; 345/97; 345/100; 345/104; 345/173; 345/205; 345/206; 345/207; 349/159

(58) Field of Search ..... 345/90, 91, 92, 345/205, 206, 97, 98, 100, 104, 173, 207, 89; 349/159

(56) References Cited

U.S. PATENT DOCUMENTS 5,844,535 A * 12/1998 Itoh et al. ..... 345/92
5,945,972 A * 8/1999 Okumura et al. ..... 345/98
5,977,940 A * 11/1999 Akiyama et al. ..... 345/94
6,310,598 B1 * 10/2001 Koyama et al. ..... 345/98
6,331,844 B1 * 12/2001 Okumura et al. ..... 345/87

FOREIGN PATENT DOCUMENTS

| | | |
|---|---|---|
| JP | 59-65879 | 4/1984 |
| JP | 06-102530 | 4/1994 |
| JP | 08-194205 | 7/1996 |
| JP | 10-228012 | 8/1998 |

* cited by examiner

*Primary Examiner*—Richard Hjerpe
*Assistant Examiner*—Jennifer T. Nguyen
(74) *Attorney, Agent, or Firm*—Oliff & Berridge, PLC

(57) ABSTRACT

Writing and holding a data signal to and in a memory circuit in a pixel driving circuit are controlled according to whether a row scanning line and a column scanning line are selected or not. According to a data signal held in the memory circuit, a pixel driver connects a first voltage signal line or a second voltage signal line to a pixel. A reference voltage is applied to a counter electrode of a counter substrate, and display is performed by a potential difference between the reference voltage and a first voltage signal or a second voltage signal.

4 Claims, 13 Drawing Sheets

ELECTROOPTIC DEVICE AND ELECTRONIC EQUIPMENT

BACKGROUND OF THE INVENTION

1. Field of the Invention

The present invention relates to an electro-optic device that has a driving circuit which may consist of a memory circuit and a pixel driver that is provided for each pixel and that controls pixel display according to a data signal held in the memory circuit, and to electronic equipment, such as office automation equipment and portable equipment in which the electro-optic device is installed.

2. Description of Related Art

In recent years, as an information display device of portable equipments or the like, including a portable telephone and a portable information terminal, a liquid crystal device, which is an example of an electro-optic device, has been in use. The contents of displayed information have been conventionally displayed in characters. These days, however, dot-matrix liquid crystal panels have been used to display more information at a time, and the number of pixels is gradually increasing with a consequent higher duty.

Hitherto, for the above portable equipment, a passive matrix liquid crystal device has been used as a display device. However, a passive matrix liquid crystal device requires a higher voltage with an increasing duty for a selection signal of a scanning line when performing multiplex drive, posing a serious problem in battery-driven portable equipment that is strongly required to minimize power consumption.

To solve such a problem, there has been proposed a static drive liquid crystal device in which one of a pair of substrates constituting a liquid crystal panel is formed of a semiconductor substrate, and a memory circuit shown in FIG. 12 is formed on the semiconductor substrate for each pixel to conduct display control based on data held in the memory circuit. In conjunction with FIG. 12, an operation of a conventional static drive liquid crystal device will now be described.

A scanning line drive circuit 410 is controlled by a scanning line drive circuit control signal 418, and a selection signal (scanning signal) is output to a selected scanning line 409-n ("n" is a natural number denoting a number of scanning lines). Likewise, a data line drive circuit 413 is controlled by a data line drive circuit control signal 419, and data signals are supplied to a selected pair of data lines 411-m and 412-m ("m" is a natural number denoting a number of data lines) so that they have mutually opposite phases (complementary signals).

At an intersection of the scanning line 409-n and the pair of data lines 411-m and 412-m, a circuit connected to those lines constitutes a pixel. n-channel MOS switching circuits 401 and 402 connected to the scanning line 409-n and the pair of data lines 411-m and 412-m are set to a conducting state when the scanning line 409-n is selected and a selection signal is supplied, and write complementary data signals of the pair of data lines 411-n and 412-m to a memory circuit 403. The memory circuit 403 has two inverters in feedback connection. Then, the scanning line 409-n is set at a non-selective potential and the pair of data lines 411-m and 412-m are set at a high impedance to thereby place the switching circuits 401 and 402 in a nonconducting state, and the data signals written to the memory circuit 403 are retained.

A liquid crystal pixel driver 404 composed of two transmission gate circuits is controlled by potential levels of a first node in the memory circuit 403 and a second node at an inverted level of a potential level at a point of connection of the first node. A first transmission gate circuit is connected to a first voltage signal line 416 and conducts according to a level of a data signal held by the memory circuit 403, and applies a first voltage 414 to a pixel electrode 406. On the other hand, a second transmission gate circuit is connected to a second voltage signal line 417 and conducts according to a level of a data signal held by the memory circuit 403, and applies a second voltage 415 to the pixel electrode 406. To be more specific, if the held data signal is at an H-level, then the first voltage signal line 416 that sets a liquid crystal layer 407 of a liquid crystal pixel driver 404 to an ON state in the case of a normally white display mode conducts, causing the first voltage 414 to be supplied to the pixel electrode 406 via the first transmission gate circuit of the liquid crystal driver 404, so that the liquid crystal pixel 405 is set to in a black display mode by a potential difference from a reference voltage 420 supplied to a common electrode 408. Similarly, if the held data signal is at an L-level, then the second voltage signal line 417 that sets the liquid crystal layer 407 in an OFF state conducts, causing the second voltage 415 to be supplied to the liquid crystal pixel 405 via the second transmission gate circuit of the liquid crystal driver 404, so that the liquid crystal pixel 405 is placed in a white display mode.

The foregoing structure allows a line voltage, the first and second voltage signals, and a reference voltage to be driven by a logic voltage alone. Also, little current exept leakage current flow, because it is able to hold display screen by a data hold function of a memory circuit, in the case that the rewriting of a screen display is not necessary. Accordingly, consumption electric power can be reduced.

However, in the conventional static drive liquid crystal device, the data signals for the pair of data lines must be complementary signals having phases opposite to each other for writing data, and must be controlled to a high impedance for holding data. Thus, control of the data lines has been extremely complicated, and a circuit configuration has also been complicated.

SUMMARY OF THE INVENTION

The present invention has been made to solve the problem described above, and it is an object of the present invention to provide an electro-optic device that consumes less power, and features a simple control method and a simple control circuit configuration.

An electro-optic device in accordance with the present invention has, on a substrate, a plurality of row scanning lines and a plurality of column scanning lines that intersect with each other, a plurality of data lines provided along the column scanning lines, voltage signal lines that supplies voltage signals, and a plurality of pixel drive circuits disposed, corresponding to intersections of the row scanning lines and the column scanning lines, wherein each of the pixel drive circuits has a switching circuit that is set to a conducting mode when the row scanning lines and the column scanning lines are selected, while it is set to a nonconducting mode when at least either the row scanning lines or the column scanning lines are not selected, a memory circuit that captures data signals of the data lines when the switching circuit is in the conducting mode, while it holds data signals when the switching circuit is in the nonconducting mode, and a pixel driver that outputs a first voltage signal to the pixel from the voltage signal line when a data signal held in the memory circuit is at a first level, while it outputs a second voltage signal to the pixel from the voltage signal line when the data signal is at a second level.

The configuration in accordance with the present invention enables a line voltage, the first and second voltage signals, and a reference voltage to be driven at a level of a logic voltage. Furthermore, little current flows, because when there is no need to rewrite screen display, a display state can be held by a data holding function of the memory circuit. With this arrangement, comparison as a liquid crystal device indicates that power consumption is cmarkedly reduced as compared with the conventional passive matrix liquid crystal device. Moreover, unlike the conventional static drive liquid crystal device, it is no longer necessary to carry out the complicated control wherein data signals for a pair of data lines are set to have opposite phases for writing data, and set at a high impedance for holding data, thus providing an advantage in that a circuit configuration can be simplified.

Furthermore, the electro-optic device in accordance with the present invention may be provided with a latch circuit that captures, for each data line, data signals into associated data lines when the column scanning lines are selected, while it holds the data signals of the data lines when the column scanning lines are not selected. According to this configuration, only a selected data line produces a capacitance parasitic to an input data line, providing an advantage in that charging/discharging currents caused by changes of signals of input data lines are markedly reduced with consequent markedly reduced power consumption.

Furthermore, the foregoing electro-optic device in accordance with the present invention may consist of a pixel electrode disposed at the pixel that is a light reflective type electrode, and the pixel driving circuit may be provided under the pixel electrode via an electrical insulation film. This configuration provides an advantage in that an aperture ratio is markedly improved and a brighter easier-to-read screen can be obtained, as compared with a conventional static drive liquid crystal device in which a TFT (Thin Film Transistor) is formed on a transparent substrate, and in which an aperture ratio of a pixel has been limited by an area of a pixel driving circuit occupied in an area of one pixel.

Moreover, the foregoing electro-optic device in accordance with the present invention may be provided with a plurality of switching control circuits that output a conduction control signal to the switching circuit when the row scanning line and the column scanning line are selected, and output a nonconduction control signal to the switching circuit when at least either the row scanning line or the column scanning line are not selected, and the switching control circuits control the switching circuits in the plural pixel driving circuits. With this arrangement, a number of the switching control circuits can be reduced, and the circuit configurations and the control of the column scanning line driving circuits can be simplified. In addition, there is an advantage in that a writing operation of an entire screen can be quickly completed, permitting a reduction in power consumption.

Furthermore, the foregoing electro-optic device in accordance with the present invention is comprising a row scanning line driving circuit for supplying a row scanning signal to the row scanning line and a column scanning line driving circuit for supplying a column scanning signal to the column scanning line, and at least either the row scanning line driving circuit or the column scanning line driving circuit is constituted by a shift register circuit. This configuration provides an advantage in that a circuit configuration and control of the scanning line driving circuits can be simplified.

In addition, the foregoing electro-optic device in accordance with the present invention may be constituted by a row scanning line driving circuit for supplying row scanning signals to the row scanning lines and a column scanning line driving circuit for supplying column scanning signals to the column scanning lines, wherein at least either the row scanning line driving circuit or the column scanning line driving circuit is constitued by a decoder circuit that selects a pertinent scanning line according to an address signal of a number of bits corresponding to a number of scanning lines. With this arrangement, when only a part of display on a screen needs to be rewritten, a pixel driving circuit of only a target pixel can be controlled to rewrite a data signal, providing an advantage in that power consumption can be markedly reduced.

Furthermore, the foregoing electro-optic device in accordance with the present invention may consist of a circuit device structure in the electro-optic that device is a CMOS structure. This arrangement provides an advantage in that leakage current is no longer produced during a data holding period, making it possible to further reduce power consumption.

Moreover, an electronic equipment in accordance with the present invention may be equipped with the electro-optic device in accordance with the present invention described above. With this arrangement, an advantage is provided in which a markedly longer service life can be achieved, as compared with an electronic equipment using a conventional passive matrix liquid crystal device when performing battery drive, and a simpler control method and a simpler control circuit configuration than those in a conventional static drive liquid crystal device can be accomplished.

DETAILED DESCRIPTION OF PREFERRED EMBODIMENTS

The following will describe embodiments of the present invention in conjunction with the accompanying drawings.

(First Embodiment)

Figure 1:
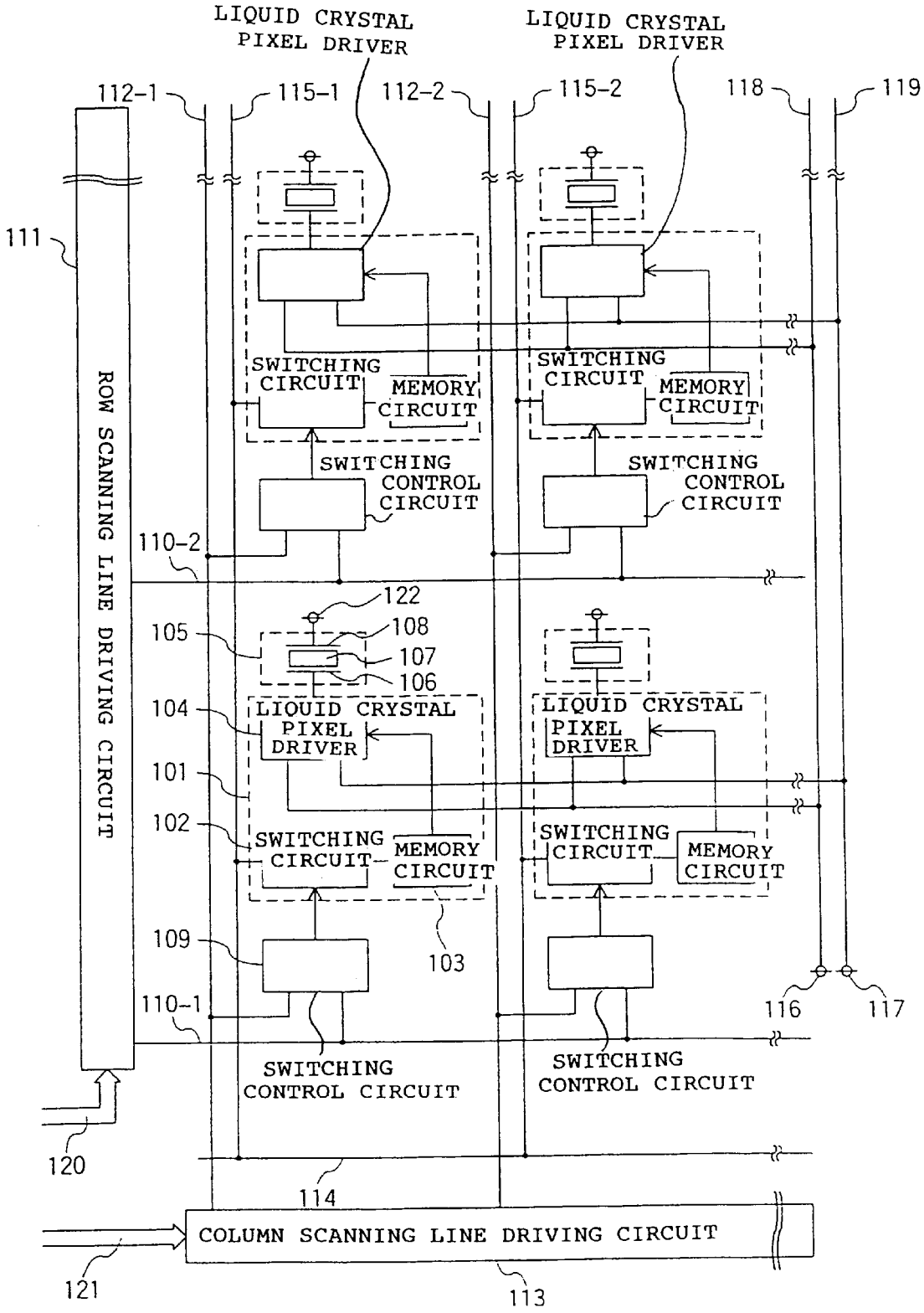
FIG. 1 is a block diagram showing essential sections of pixels and driving circuits or the like thereof in an electro-optic device based on a first embodiment in accordance with the present invention.
Figure 2:
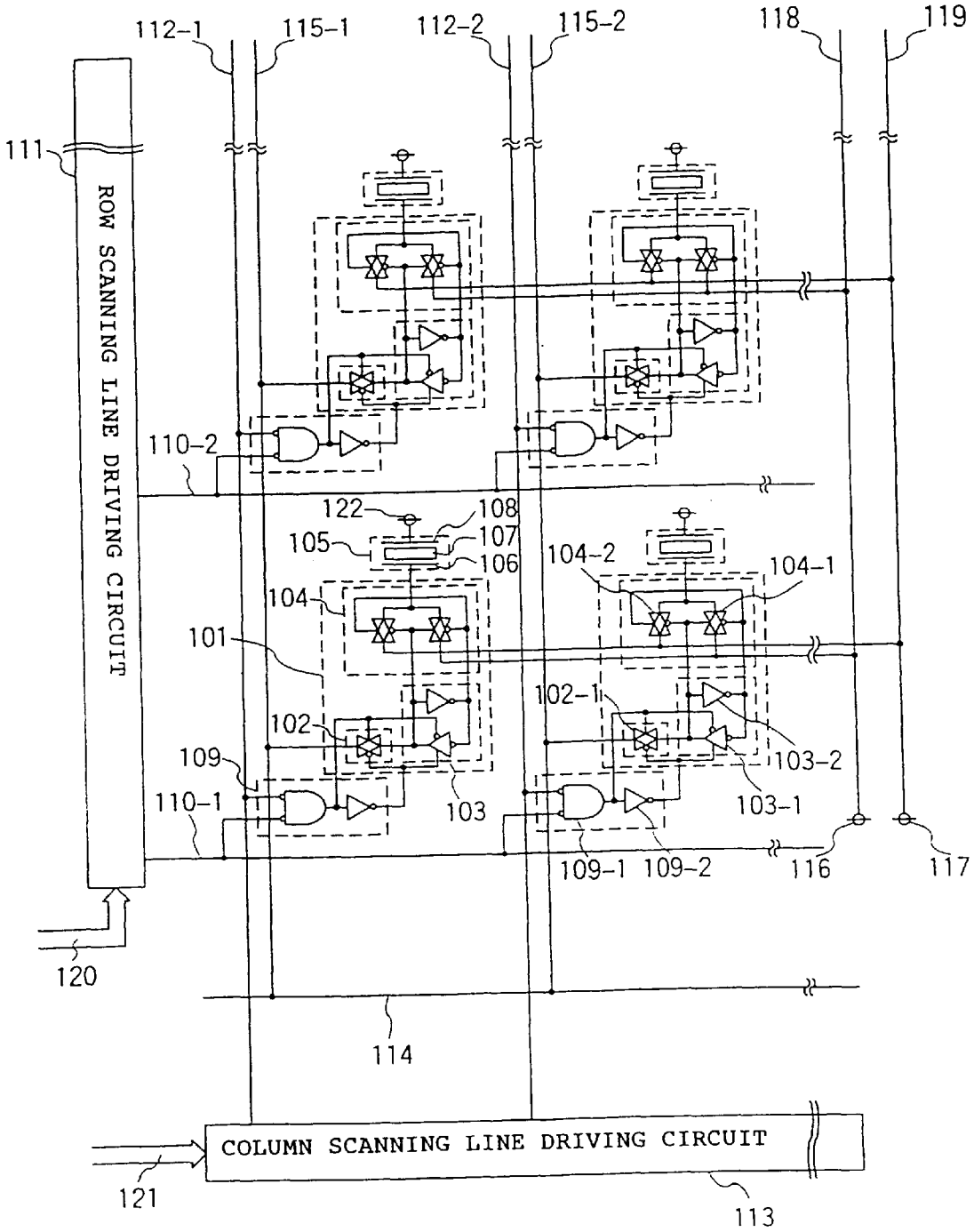
FIG. 2 is a circuit diagram showing a driving circuit of the electro-optic device based on the first embodiment in accordance with the present invention, the driving circuit being constituted by a CMOS transistor.

FIG. 1 is a block diagram showing essential sections of pixels and driving circuits or the like thereof in an electro-optic device based on a first embodiment in accordance with the present invention. FIG. 2 is a detailed circuit diagram of FIG. 1.

Referring to FIG. 1, in a pixel region, row scanning lines 110-n ("n" indicates a natural number denoting a row of a row scanning line) and column scanning lines 112-m ("m" indicates a natural number denoting a column of a column scanning line) are arranged in a matrix pattern, and a driving circuit of each pixel is formed at an intersection of the row and column scanning lines. Furthermore, in the pixel region, a column data line 115-d ("d" indicates a natural number denoting a column of a column data line) branched from an input data line 114 is also disposed along the column scanning line 112-m. A row scanning line driving circuit 111 is disposed in a peripheral region adjacent to rows in the pixel region, and a column scanning line driving circuit 113 is disposed in a peripheral region adjacent to columns in the pixel region.

The row scanning line driving circuit 111 is controlled by a row scanning line driving circuit control signal 120, and a selection signal (scanning signal) is output to a selected row scanning line 110-n. Row scanning lines that have not been selected are set at a nonselective potential. Likewise, the column scanning line driving circuit 113 is controlled by a column scanning line driving circuit control signal 121, a selection signal is output to a selected column scanning line 112-m, and column scanning lines that have not been selected are set at a nonselective potential. A row scanning line and a column scanning line to be selected are decided by the control signals 120 and 121. In other words, the control signals 120 and 121 are address signals for specifying pixels to be selected.

A switching control circuit 109 disposed in the vicinity of an intersection of a selected row scanning line 110-n and a selected column scanning line 112-m outputs an ON signal (conduction control signal) upon receipt of selection signals of the two scanning lines, and outputs an OFF signal (nonconduction control signal) that renders at least one of the row scanning line 110-n and the column scanning line 112-m nonselective. In other words, the ON signal is issued only from the switching control circuit 109 for the pixel positioned at the intersection of the selected row scanning line and column scanning line, while the OFF signals are issued from the remaining switching control circuits. In this embodiment, a liquid crystal pixel driving circuit 101 is controlled by the ON and OFF signals of the switching control circuits 109.

A configuration and operation of the liquid crystal pixel driving circuit 101 will now be described.

A switching circuit 102 is set to a conducting mode by the ON signal of the switching control circuit 109, while it is set to a nonconducting mode by the OFF signal. When the switching circuit 102 is set to the conducting state, a data signal of a column data line 115-d connected thereto is written to a memory circuit 103 via the switching circuit 102. On the other hand, the switching circuit 102 is set to the nonconducting state by the OFF signal of the switching control circuit 109, and it holds the data signal written to the memory circuit 103.

The data signal held in the memory circuit 103 is supplied to a liquid crystal pixel driver 104 disposed for each pixel. According to a level of the supplied data signal, the liquid crystal pixel driver 104 supplies either a first voltage 116 applied to a first voltage signal line 118, or a second voltage 117 is applied to a second voltage signal line 119 to a pixel electrode 106 of a liquid crystal pixel 105. In the present invention, a pixel refers to an electro-optic material that electrically performs optical actions, such as optical modulation and luminescence, or a pixel electrode for each pixel that applies electrical actions to the above. When a liquid crystal device is in a normally white display mode, the first voltage 116 sets the liquid crystal pixel 105 to a black display mode, while the second voltage 117 sets the liquid crystal pixel 105 to a white display mode.

In the liquid crystal pixel driver 104, when a data signal retained at the memory circuit 103 is at an H-level, a gate connected to the first voltage signal line 118 that causes a liquid crystal to provide black display in the case of a normally white display mode is set to the conducting state, the first voltage 116 is supplied to the pixel electrode 106, and a potential difference from a reference voltage 122 supplied to a common electrode 108 causes the liquid crystal pixel 105 to be set to the black display mode. Similarly, when the held data signal is at an L-level, in the liquid crystal pixel driver 104, a gate connected to the second voltage signal line 119 is set to the conducting state, and the second voltage 117 is supplied to the pixel electrode 106, causing the liquid crystal pixel 105 to be set to the white display mode.

The configuration discussed above allows a line voltage, the first and second voltage signals, and the reference voltage to be driven at a level of a logic voltage, and little current exept leakage current flow, because it is able to hold display screen by a data hold function of a memory circuit, in the case that the rewriting of a screen display is not necessary. In addition, writing to a pixel is controlled by a logic of the selection signals of the two scanning lines, namely, rows and columns, so as to enable control of the pixels independently of potentials of the data lines. This arrangement obviates the need for complicated control in a conventional static drive liquid crystal device in which data signals of two data lines are set to have opposite phases (complementary data signals) for writing when data is written, and in which the data lines are set at a high impedance for holding data so as to set transistors connected to the data lines to a nonconducting state.

Each of the liquid crystal pixels 105 is provided with the pixel electrode 106 to which either the first voltage 116 or the second voltage 117 selected according to a held data signal is supplied from the liquid crystal pixel driver 104. A liquid crystal layer 107 lying between the pixel electrode 106 and the common electrode 108 is subjected to a potential difference between the two electrodes, and the black display mode (or the ON display mode) or the white display mode (or the OFF display mode) is set according to a change in alignment of liquid crystal molecules based on the potential difference. In a liquid crystal device, a liquid crystal is sealed and sandwiched between a semiconductor substrate and a light transmitting substrate, such as glass, pixel electrodes are disposed in a matrix pattern on the semiconductor substrate, and the liquid crystal pixel driving circuits, the row scanning lines, the column scanning lines, the data lines, the row scanning line driving circuit, the column scanning line driving circuit, etc. mentioned above are formed under the pixel electrodes. Highly mobile complementary transistors having a MOS structure can be formed on a semiconductor substrate, and a multilayer wiring structure can be easily formed. Hence, by using the transistors and the multilayer wiring, various circuits mentioned above can be configured. For each pixel, a voltage is applied (pixel by pixel) between the pixel electrode 106 and the common electrode 108 formed on an inner surface of the opposing light transmitting substrate, thereby supplying a voltage to the liquid crystal layer 107 for each pixel that lies therebetween so as to change the alignment of liquid crystal molecules for each pixel.

In this case, if the pixel electrode 106 of the liquid crystal pixel 105 is formed as a light reflecting electrode of a metal, a dielectric multilayer film, or the like, and the liquid crystal pixel driving circuit 101 is provided on the semiconductor substrate under the liquid crystal pixel electrodes via an electrical insulation film, then an aperture ratio is markedly improved. More specifically, in the past, each liquid crystal pixel driving circuit was formed using a TFT on a light transmitting substrate, and an area occupied by the liquid crystal pixel driving circuit, which does not provide a light transmitting region, in an area of one pixel limited the aperture ratio of the liquid crystal pixel. In comparison, the pixel electrodes and the liquid crystal pixel driving circuits are laminated according to the present invention, so that reflective pixel electrodes that occupy almost an entire area of one pixel can be disposed above the liquid crystal pixel driving circuit. Therefore, the aperture ratio can be dramatically improved, allowing a brighter, easier-to-read screen to be achieved.

Figure 9:
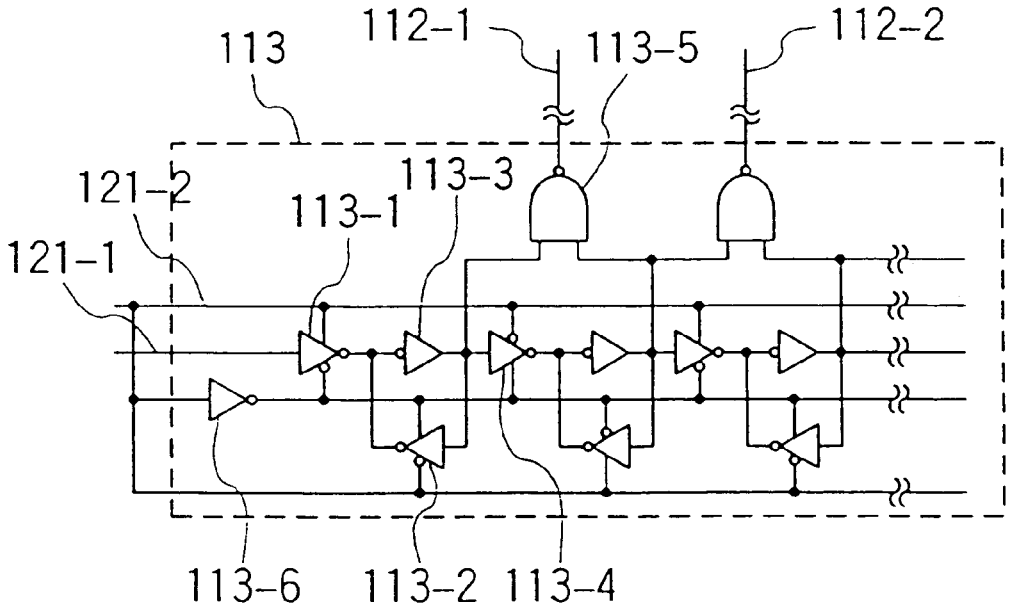
FIG. 9 is a circuit diagram showing a scanning line driving circuit of the electro-optic device based on the first to fourth embodiments in accordance with the present invention that is constituted by a shift register circuit formed using a CMOS transistor.

The column scanning line driving circuit 113 of FIG. 1 can be formed using a shift register circuit shown in FIG. 9. In FIG. 9, a column scanning line driving circuit control signal 121 composed of two signals, namely, a scanning signal 121-1 of positive logic (H-level is an active level) and a clock signal 121-2 is inputted, the column scanning lines 112-m can be selected in sequence in synchronization with the clock signal 121-2 by negative logic (L-level is an active level). More specifically, the clock signal 121-2, together with a signal that has been inverted by an inverter 113-6 formed of a CMOS transistor, is used as a control signal for the shift register circuit. The scanning signal 121-1 is captured by a clocked inverter 113-1 formed of a CMOS transistor in a first stage at a rise of the clock signal 121-2, inverted by an inverter 113-3 formed of a CMOS transistor, and an output is fed back by clocked inverters 113-2 and 113-4 formed of two CMOS transistors at a fall of the clock signal 121-2 to perform an operation for holding a scanning signal and an operation for transferring the scanning signal to the following stage, thereby transferring the scanning signals in sequence. A NAND gate circuit 113-5 formed of a CMOS transistor obtains a logical conjection of outputs of two adjoining stages, and outputs selection signals. The NAND gate circuit 113-5 is provided so that output phases of the selection signals 112-m and 112-m+1 do not overlap each other. With this arrangement, the scanning lines are selected one after another.

Similarly, configuring the row scanning line driving circuit 111 by a shift register circuit similar to that shown in FIG. 9 makes it possible to simplify the circuit configurations and control of the two scanning line driving circuits.

Figure 10:
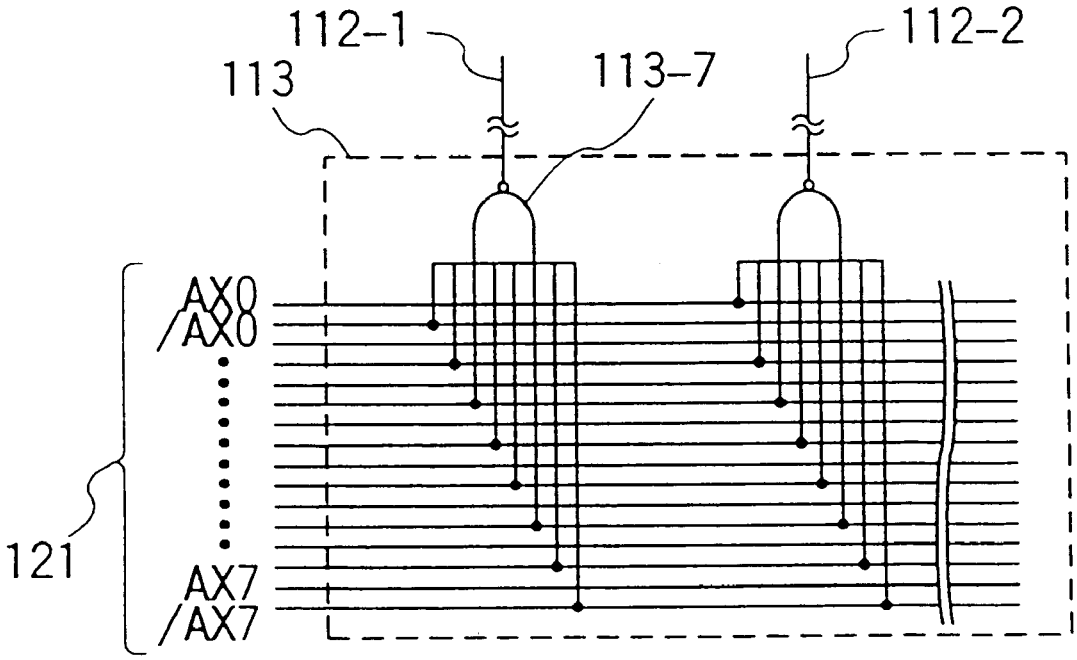
FIG. 10 is a circuit diagram showing a scanning line driving circuit of the electro-optic device based on the first to fourth embodiments in accordance with the present invention that is constituted by a decoder circuit formed using a CMOS transistor.

The column scanning line driving circuit 113 can be formed of a decoder circuit of a number of bits (AX0, /AX0, to AX7, /AX7) corresponding to a number of scanning lines, as shown in FIG. 10. The decoder circuit can be configured to receive the column scanning line driving circuit control signal 121 composed of an address signal, wherein the control signal 121 is decoded by a NAND gate circuit 113-7 formed of a CMOS transistor to select a corresponding column scanning line 112-m, and a selection signal can be output. This arrangement allows a selection signal to be output to an arbitrary scanning line according to an address signal, permitting pixels to be accessed at random.

By configuring the row scanning line driving circuit 111 by a decoder circuit similar to that shown in FIG. 10 inr, when only partial display on a screen has to be rewritten, a liquid crystal pixel driving circuit for only a target pixel can be controlled to rewrite a data signal. In the present invention, each pixel is provided with the memory circuit 103, and unless the switching circuit 102 conducts by a selection signal of row and column scanning lines, the data signal written to the memory circuit 103 is retained. Hence, only the pixel to be rewritten can be accessed for rewriting.

As shown in FIG. 2, in this embodiment, the switching control circuit 109 can be configured by a logic circuit of a NOR gate circuit 109-1 formed of a CMOS transistor and an inverter 109-2 formed of a CMOS transistor. The NOR gate circuit 109-1 outputs an ON signal of the positive logic when selection signals of the negative logic are applied to two inputs thereof, and an ON signal of the negative logic is output by the inverter 109-2. Furthermore, the switching circuit 102 can be configured by a transmission gate 102-1 formed of a CMOS transistor. The transmission gate 102-1 is set to the conducting state based on the ON signal of the switching control circuit 109 to connect the column data line 115 and the memory circuit 103, whereas it is set to the nonconducting state based on the OFF signal. The memory circuit 103 can be configured so that a clocked inverter 103-1 formed of a CMOS transistor and an inverter 103-2 formed of a CMOS transistor are feedback-connected. The data signal is captured from the switching circuit 102 into the memory circuit 103 in response to an ON signal of the switching control circuit 109 and inverted by the inverter 103-2, and an output is fed back by a clocked inverter 103-1 operated by the OFF signal of the switching control circuit 109 so as to hold the data signal. The liquid crystal pixel driver 104 can be configured by transmission gates 104-1 and 104-2 formed of two CMOS transistors. If the data signal held at the memory circuit 103 is at the H-level, then the transmission gate 104-1, which is connected to the first voltage signal line 118 that causes a liquid crystal to provide the black display in the case of the normally white display mode, is set to a conducting state in the liquid crystal pixel driver 104, and the first voltage 116 is supplied to the pixel electrode 106, causing the liquid crystal pixel 105 to be set to the black display mode due to a potential difference from the reference voltage 122 supplied to the common electrode 108. Similarly, if the held data signal is at the L-level, then the transmission gate 104-2 connected to the second voltage signal line 119 is set to the conducting state, causing the second voltage 117 to be supplied to the pixel electrode 106, so that the liquid crystal pixel 105 is set to the white display mode.

Figure 13:
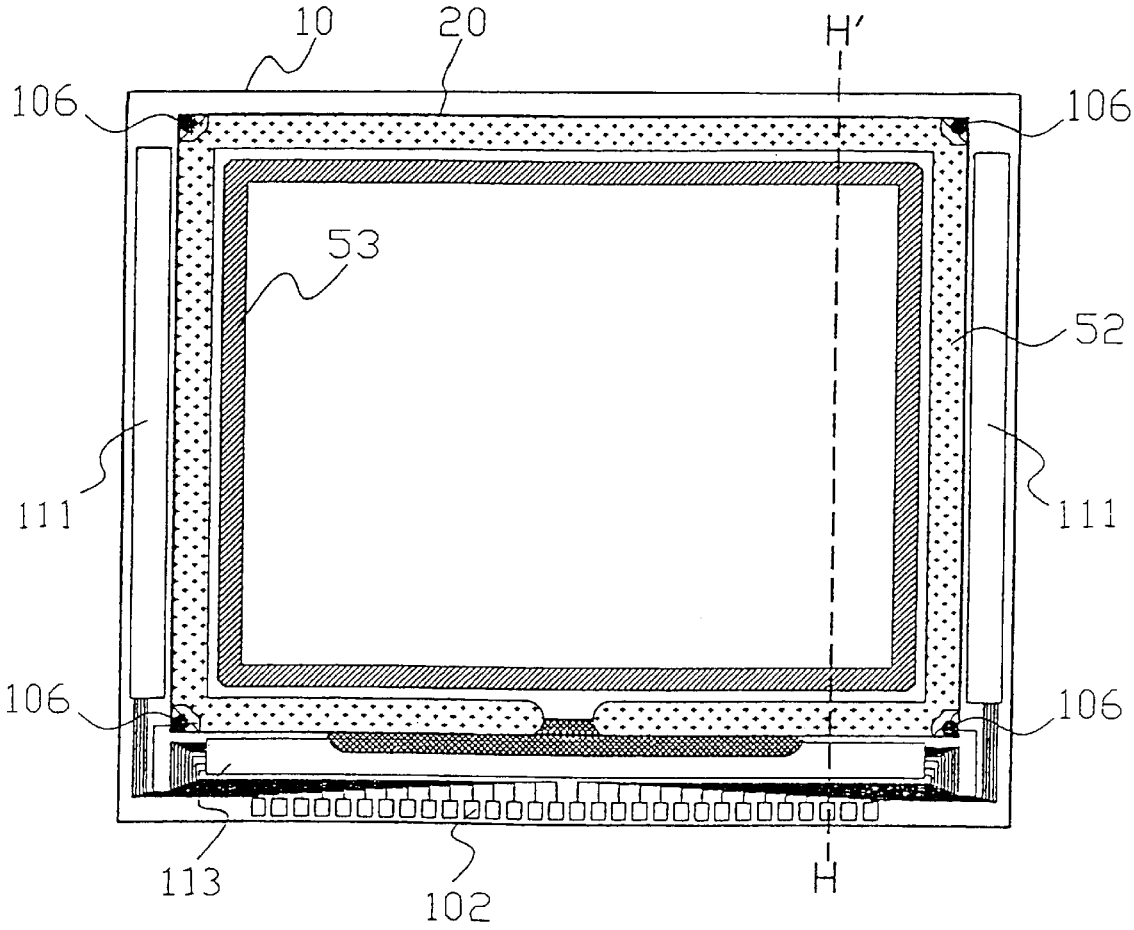
FIG. 13 is a top plan view of a liquid crystal device.
Figure 14:
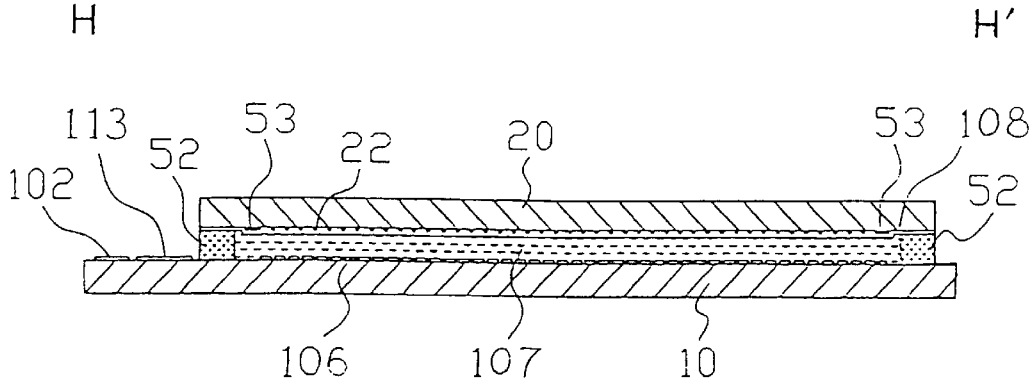
FIG. 14 is a sectional view of the liquid crystal device of FIG. 13.

The entire configuration of the liquid crystal device constituted as described above will now be explained with reference to FIG. 13 and FIG. 14. FIG. 13 is a top plan view of a liquid crystal device substrate 10 with components formed thereon, observed from a side of a opposite substrate 20, and FIG. 14 is a sectional view taken at the line XIV—XIV of FIG. 13 that includes the opposite substrate 20.

In FIG. 13, a sealing member 52 is provided on the liquid crystal device substrate 10 composed of, for example, a semiconductor substrate, along an edge thereof, and a light-shielding film (picture frame) 53 that surrounds a non-pixel region is provided around a pixel region in parallel to an inner side of the sealing constituent 52. In a region on an outer side of the sealing constituent 52, a column scanning line driving circuit 113 and a mounting terminal 102 are provided along one side of the liquid crystal device substrate 10, and the row scanning line driving circuits 111 are provided along two sides adjacent to the foregoing one side. If a delay of a row scanning signal supplied to a row scanning line 110 does not pose a problem, then a row scanning line driving circuit 111 may be provided only on one side. The opposite substrate 20 is formed of a transparent substrate, such as glass, and a conducting member 123 for providing electrical conduction between the liquid crystal device substrate 10 and the opposite substrate 20 is provided in at least one place of a corner portion of the opposite substrate 20. The opposite substrate 20 is secured to the liquid crystal device substrate 10 by the sealing constituent 52. Furthermore, the liquid crystal 107 is sealed in a gap formed by a pair of the substrates 10 and 20. The liquid crystal 107 may employ a variety of liquid crystals, including a twisted nematic (TN) type, a homeotropic alignment type, a planar alignment type without twist, a bistable type such as a ferroelectric type, and a polymer dispersed type or the like. In FIG. 14, reference numeral 106 denotes pixel electrodes arranged in a matrix pattern in a pixel region on the liquid crystal device substrate 10, reference numeral 22 denotes a black matrix (this may be omitted) formed on the opposite substrate 20, and reference numeral 108 denotes common electrodes composed of ITO formed on the opposite substrate 20. Alternatively, the pixel electrodes 106 and the common electrodes 108 may be disposed to oppose each other on the liquid crystal device substrate 20, and a transverse electric field may be applied to the liquid crystal 107. Furthermore, the liquid crystal device substrate 10 may use a glass substrate rather than the semiconductor substrate, and the pixel driving circuits may be constituted using a thin-film transistors composed of silicon layers formed on substrates to constitute the electro-optic device in accordance with the present invention.

In the following embodiments, the constitution of the liquid crystal device will be the same as that shown in FIG. 13 and FIG. 14.

[Second Embodiment]

Figure 3:
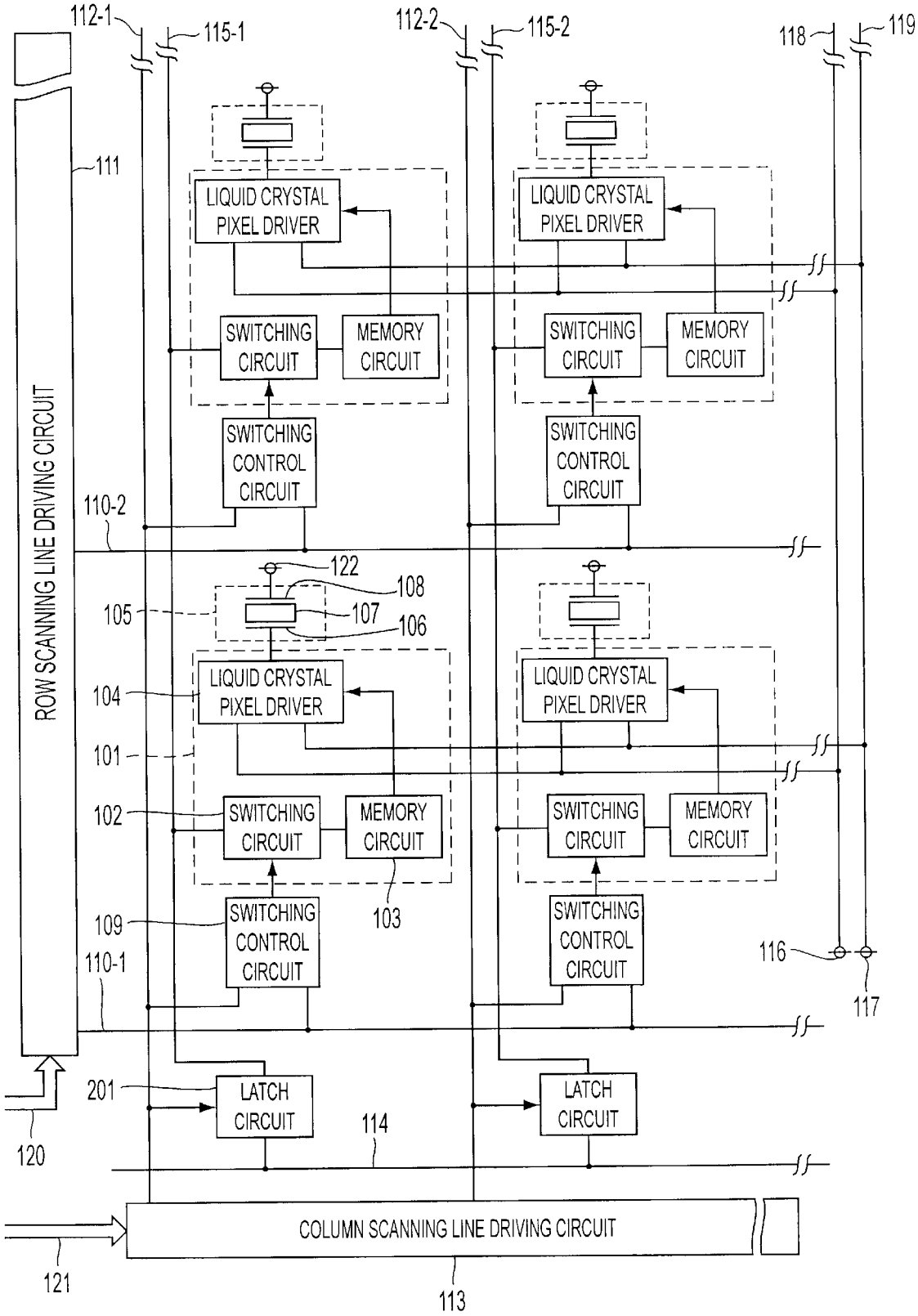
FIG. 3 is a block diagram showing essential sections of pixels and driving circuits or the like thereof in an electro-optic device based on a second embodiment in accordance with the present invention.
Figure 4:
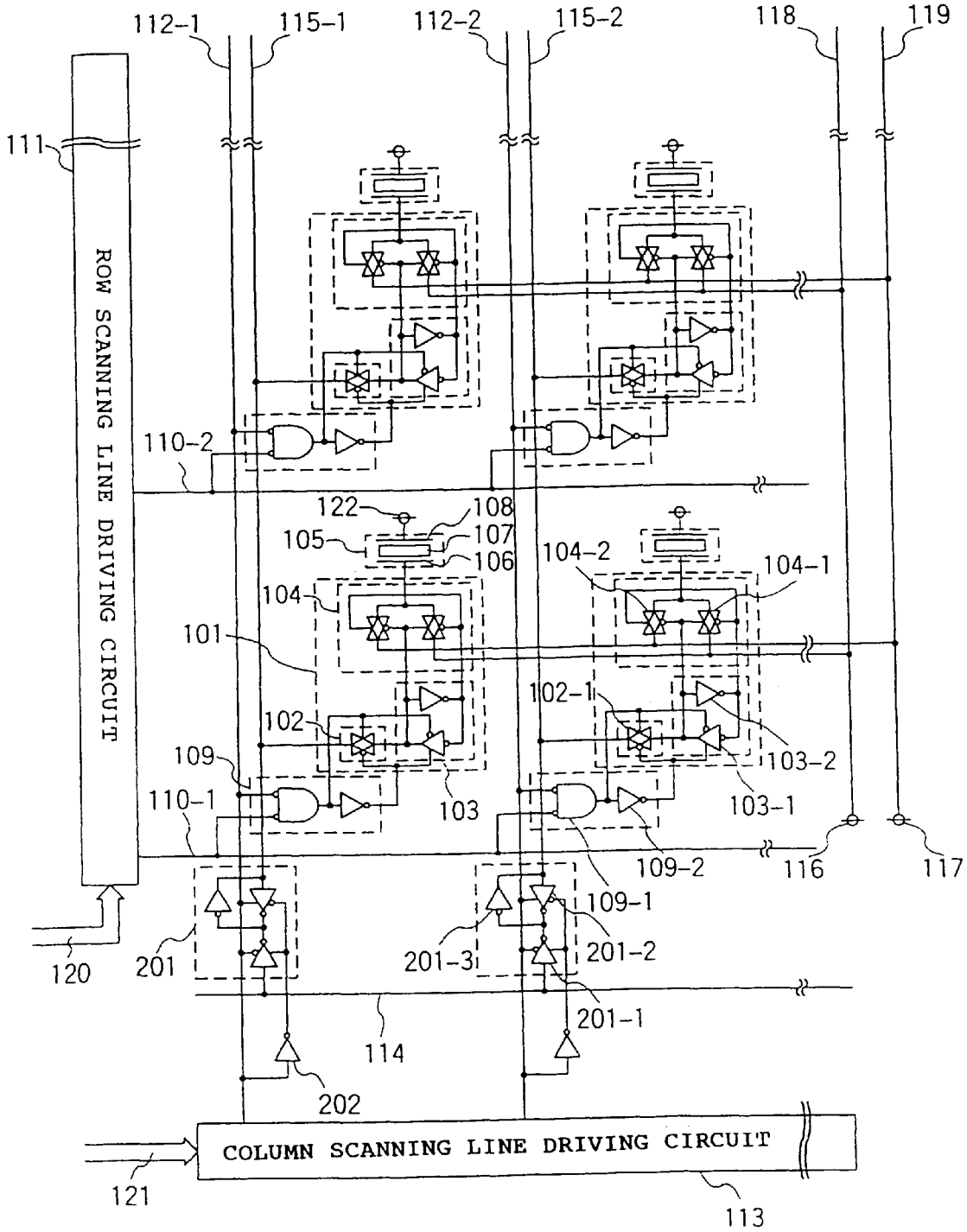
FIG. 4 is a circuit diagram showing a driving circuit of the electro-optic device based on the second embodiment in accordance with the present invention, the driving circuit being constituted by a CMOS transistor.

FIG. 3 is a block diagram showing essential sections of pixels and driving circuits or the like in a liquid crystal device that is an electro-optic device of a second embodiment in accordance with the present invention, and FIG. 4 is a detailed circuit diagram thereof.

As shown in FIG. 3, this embodiment is configured by adding a latch circuit 201, which is disposed at a point where a column data line 115 is branched from an input data line 114, to the block diagram of FIG. 1 shown in conjunction with the first embodiment. In this embodiment, configurations not explained in particular are identical to those of the first embodiment.

When the latch circuit 201 captures a data signal from the input data line 114 into a corresponding column data line 115-d when a column scanning line 112-m is selected, or holds the data signal of a column data line 115-d when the column scanning line 112-m is not selected.

According to this configuration, a capacitance parasitic to the input data line 114 can be reduced to only a capacitance of the column data line 115 connected to the selected latch circuit 201, permitting a marked reduction in power consumption to be achieved.

As illustrated in FIG. 4, this embodiment is constituted by adding the latch circuit 201 to the circuit diagram of FIG. 2 shown in conjunction with the first embodiment. The latch circuit 201 can be constituted by a logic circuit composed of clocked inverters 201-1 to and 201-2 formed of CMOS transistors, and an inverter 201-3 formed of a CMOS transistor. A selection signal of the column scanning line 112-m, together with a signal that has been inverted by an inverter 202 formed of a CMOS transistor, is used as a signal for controlling the latch circuit 201. The data signal received from the input data line 114 is captured by the clocked inverter 201-1 in the first stage at a fall of a selection signal of the column scanning line 112-m, inverted by an inverter 201-3, and an output is fed back by the clocked inverter 201-2 at a rise of a selection signal of the column scanning line 112-m to perform an operation for holding the data signal.

[Third Embodiment]

Figure 5:
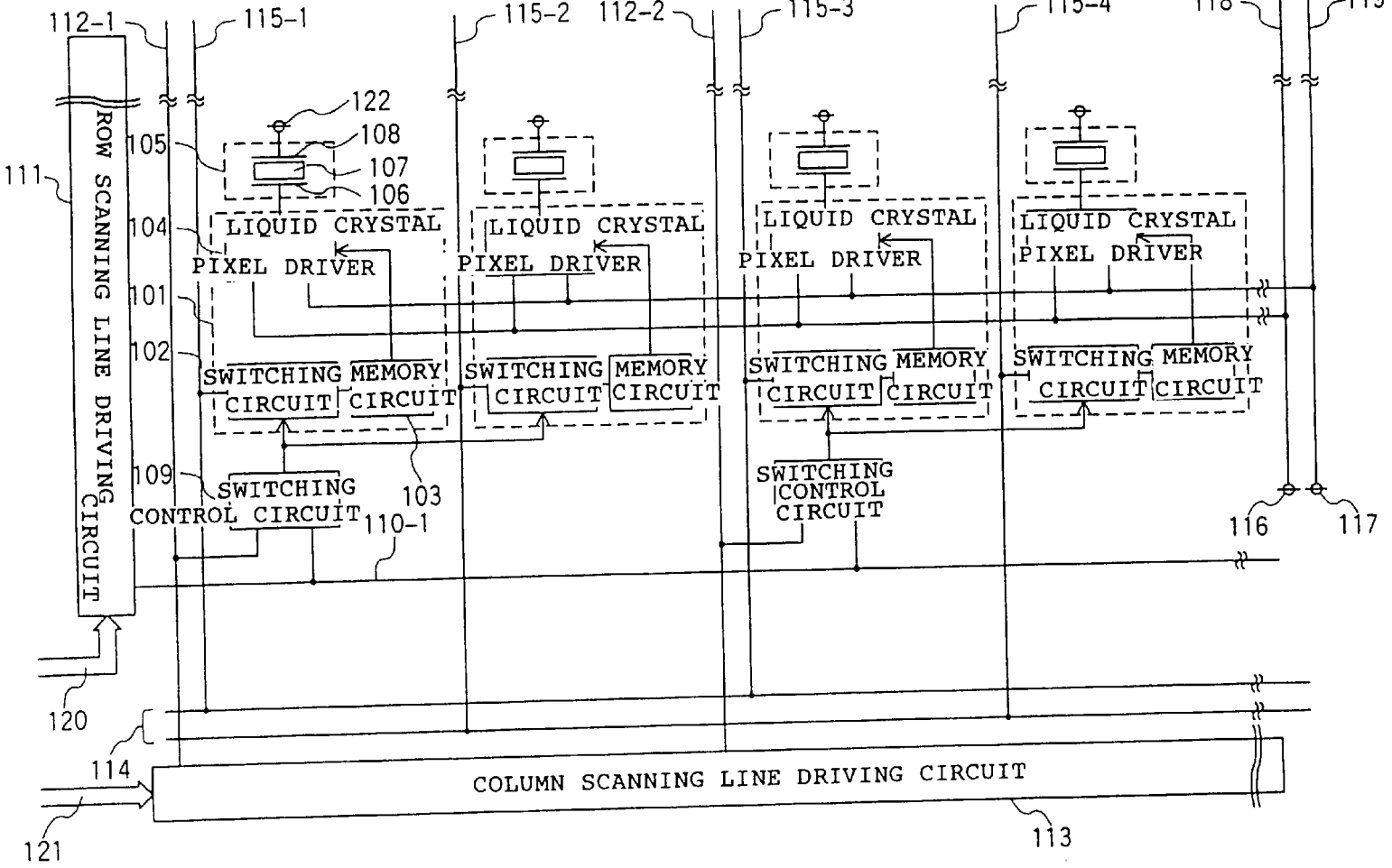
FIG. 5 is a block diagram showing essential sections of pixels and driving circuits or the like thereof in an electro-optic device based on a third embodiment in accordance with the present invention.
Figure 6:
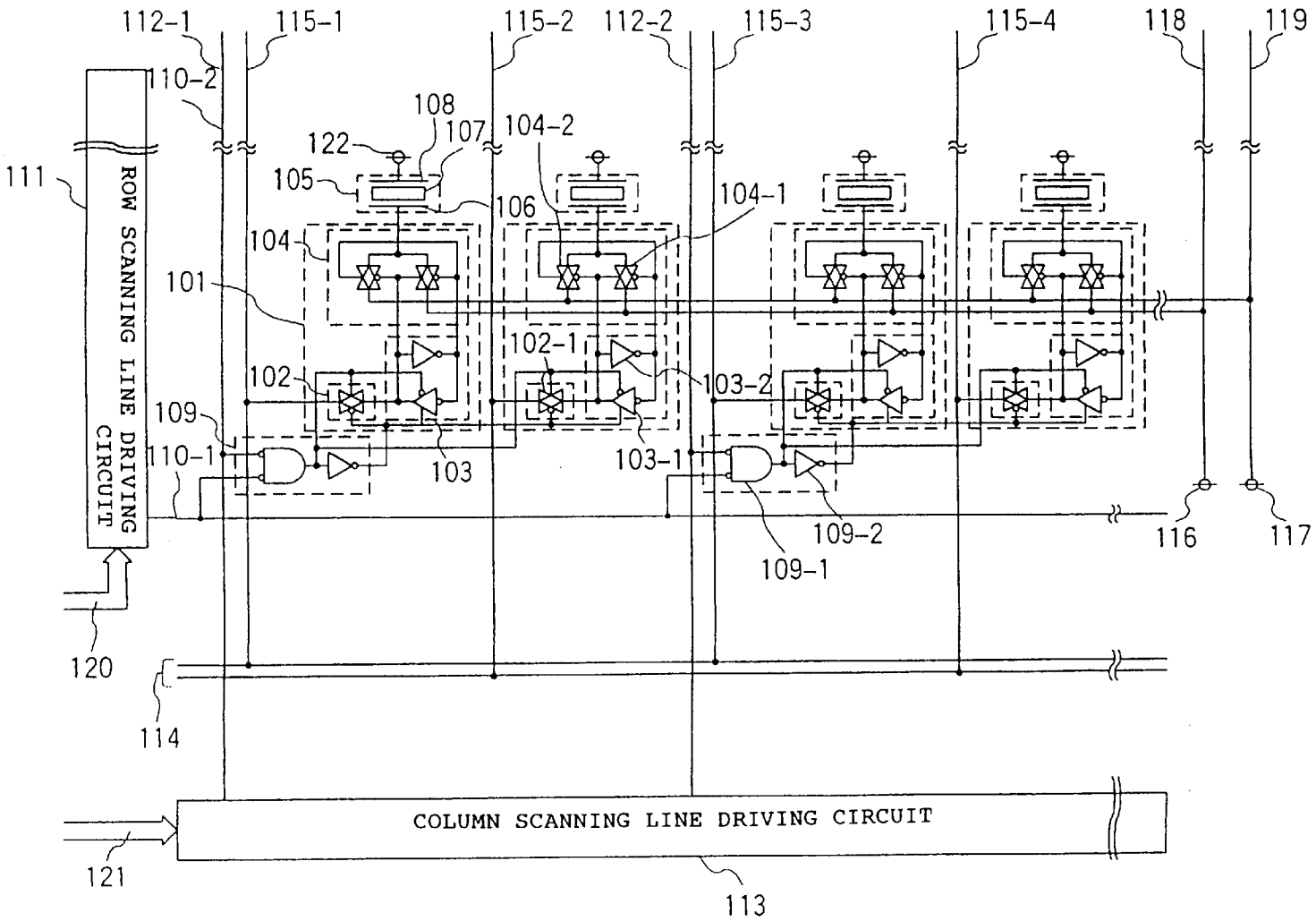
FIG. 6 is a circuit diagram showing a driving circuit of the electro-optic device based on the third embodiment in accordance with the present invention, the driving circuit being constituted by a CMOS transistor.

FIG. 5 is a block diagram showing essential sections of pixels and driving circuits thereof, or the like in a liquid crystal device that is an electro-optic device of a third embodiment in accordance with the present invention, and FIG. 6 is a detailed circuit diagram thereof.

As shown in FIG. 5, in this embodiment, two bits of simultaneous input data signal are used. In this embodiment, configurations not explained in particular are identical to those of the first embodiment.

In a pixel region, row scanning lines 110-n ("n" indicates a natural number denoting a row of a row scanning line) and column scanning lines 112-m ("m" indicates a natural number denoting a column of a column scanning line) are arranged in a matrix pattern, and a driving circuit for each pixel is formed at an intersection of the row and column scanning lines. Furthermore, in the pixel region, a column data line 115-d ("d" indicates a natural number denoting a column of a column data line) branched from two input data lines 114 for the number of simultaneous input data bits is also disposed along the column scanning line 112-m. A row scanning line driving circuit 111 is disposed in a peripheral region adjacent to rows in the pixel region, and a column scanning line driving circuit 113 is disposed in a peripheral region adjacent to columns in the pixel region.

The row scanning line driving circuit 111 is controlled by a row scanning line driving circuit control signal 120, and a selection signal (scanning signal) is output to a selected row scanning line 110-n. Row scanning lines that have not been selected are set at a nonselective potential. Likewise, the column scanning line driving circuit 113 is controlled by a column scanning line driving circuit control signal 121, a selection signal is output to a selected column scanning line 112-m, and column scanning lines that have not been selected are set at a nonselective potential. A row scanning line and a column scanning line to be selected are decided by the control signals 120 and 121. In other words, the control signals 120 and 121 are address signals for specifying pixels to be selected.

A switching control circuit 109 disposed in the vicinity of an intersection of a selected row scanning line 110-n and a selected column scanning line 112-m outputs an ON signal upon receipt of selection signals of the two scanning lines, and outputs an OFF signal that renders at least one of the row scanning line 110-n and the column scanning line 112-m nonselective. In other words, the ON signal is issued only from the switching control circuit 109 for the pixel positioned at the intersection of the selected row scanning line and column scanning line, while the OFF signals are issued from the remaining switching control circuits. In this embodiment, two liquid crystal pixel driving circuits 101 are controlled by the ON and OFF signals of the single switching control circuit 109.

A configuration and operation of the liquid crystal pixel driving circuit 101 will now be described.

A switching circuit 102 is set to a conducting state by the ON signal of the switching control circuit 109, while it is set to a nonconducting state by the OFF signal. When the switching circuit 102 is set to the conducting state, a data signal of a column data line 115-d connected thereto is written to a memory circuit 103 via the switching circuit 102. On the other hand, the switching circuit 102 is set to the nonconducting state by the OFF signal of the switching control circuit 109, and it holds the data signal written to the memory circuit 103.

The data signal held in the memory circuit 103 is supplied to a liquid crystal pixel driver 104 disposed for each pixel. According to a level of the supplied data signal, the liquid crystal pixel driver 104 supplies either a first voltage 116 applied to a first voltage signal line 118 or a second voltage 117 applied to a second voltage signal line 119 to a pixel electrode 106 of a liquid crystal pixel 105. When a liquid crystal device is in a normally white display mode, the first voltage 116 sets the liquid crystal pixel 105 to a black display mode, while the second voltage 117 sets the liquid crystal pixel 105 to a white display mode.

In the liquid crystal pixel driver 104, when a data signal retained at the memory circuit 103 is at an H-level, a gate connected to the first voltage signal line 118 that causes a liquid crystal to provide black display in the case of a normally white display mode is set to the conducting state, the first voltage 116 is supplied to the pixel electrode 106, and a potential difference from a reference voltage 122 supplied to a common electrode 108 causes the liquid crystal pixel 105 to be set to the black display mode. Similarly, when the held data signal is at an L-level, in the liquid crystal pixel driver 104, a gate connected to the second voltage signal line 119 is set to the conducting state, and the second voltage 117 is supplied to the pixel electrode 106, causing the liquid crystal pixel 105 to be set to the white display mode.

The configuration discussed above allows a line voltage, the first and second voltage signals, and the reference voltage to be driven at a level of a logic voltage. Also, little current flows, because it is able to hold display state by a data hold function of a memory circuit, in the case that the rewriting of a screen display is not necessary. In addition, writing to a pixel is controlled by a logic of the selection signals of the two scanning lines, namely, rows and columns so as to enable control of the pixels independently of potentials of the data lines. This arrangement obviates the need for complicated control in a conventional static drive liquid crystal device in which data signals of two data lines are set to have opposite phases (complementary data signals) for writing when data is written, and in which the data lines are set at a high impedance for holding data so as to set transistors connected to the data lines to a nonconducting state. Moreover, since the single switching control circuit 109 simultaneously controls the two liquid crystal pixel driving circuits 101, the switching control circuits 109 can be reduced to a half, and the circuit configurations of the column scanning line driving circuit 113 can be simplified.

Each of the liquid crystal pixels 105 is provided with the pixel electrode 106 to which either the first voltage 116 or the second voltage 117 that has been selected according to a held data signal is supplied from the liquid crystal pixel driver 104. A liquid crystal layer 107 lying between the pixel electrode 106 and the common electrode 108 is subjected to a potential difference between the two electrodes, and the black display mode (or the ON display mode) or the white display mode (or the OFF display mode) is set according to a change in alignment of liquid crystal molecules based on the potential difference. In a liquid crystal device, a liquid crystal is sealed and sandwiched between a semiconductor substrate and a light transmitting substrate, such as glass, pixel electrodes are disposed in a matrix pattern on the semiconductor substrate, and the liquid crystal pixel driving circuits, the row scanning lines, the column scanning lines, the data lines, the row scanning line driving circuit, the column scanning line driving circuit, etc. mentioned above are formed under the pixel electrodes. Highly mobile complementary transistors having a MOS structure can be formed on a semiconductor substrate, and a multilayer wiring structure can be easily formed. Hence, by using the transistors and the multilayer wiring, various circuits mentioned above can be configured. For each pixel, a voltage is applied (pixel by pixel) between the pixel electrode 106 and the common electrode 108 formed on an inner surface of the opposing light transmitting substrate, thereby supplying a voltage to the liquid crystal layer 107 for each pixel that lies therebetween so as to change the alignment of liquid crystal molecules for each pixel.

In this case, if the pixel electrode 106 of the liquid crystal pixel 105 is formed as a light reflecting electrode of a metal, a dielectric multilayer film, or the like, and the liquid crystal pixel driving circuit 101 is provided on the semiconductor substrate under the liquid crystal pixel electrodes via an electrical insulation film, then an aperture ratio is markedly improved. More specifically, in the past, each liquid crystal pixel driving circuit was formed using a TFT on a light transmitting substrate, and an area occupied by the liquid crystal pixel driving circuit, which does not provide a light transmitting region, in an area of one pixel limited the aperture ratio of the liquid crystal pixel. In comparison, the pixel electrodes and the liquid crystal pixel driving circuits are laminated according to the present invention, so that reflective pixel electrodes that occupy almost an entire area of one pixel can be disposed above the liquid crystal pixel driving circuit. Therefore, the aperture ratio can be dramatically improved, allowing a brighter, easier-to-read screen to be achieved.

The column scanning line driving circuit 113 of FIG. 5 can be formed using a shift register circuit shown in FIG. 9. In FIG. 9, a column scanning line driving circuit control signal 121 composed of two signals, namely, a scanning signal 121-1 of positive logic (H-level is an active level) and a clock signal 121-2 is inputted, and the column scanning lines 112-m can be selected in sequence in synchronization with the clock signal 121-2 by negative logic (L-level is an active level). More specifically, the clock signal 121-2, together with a signal that has been inverted by an inverter 113-6 formed of a CMOS transistor, is used as a control signal for the shift register circuit. The scanning signal 121-1 is captured by a clocked inverter 113-1 formed of a CMOS transistor in a first stage at a rise of the clock signal 121-2, inverted by an inverter 113-3 formed of a CMOS transistor, and an output is fed back by clocked inverters 113-2. and 113-4 formed of two CMOS transistors at a fall of the clock signal 121-2 to perform an operation for holding a scanning signal and an operation for transferring the scanning signal to the following stage, thereby transferring the scanning signals in sequence. A NAND gate circuit 113-5 formed of a CMOS transistor obtains a logical conjection of outputs of two adjoining stages, and outputs selection signals. The NAND gate circuit 113-5 is provided so that output phases of the selection signals 112-m and 112-m+1 do not overlap each other. With this arrangement, the scanning lines are selected one after another.

Similarly, configuring the row scanning line driving circuit 111 by a shift register circuit similar to that shown in FIG. 9 makes it possible to simplify the circuit configurations and control of the two scanning line driving circuits.

The column scanning line driving circuit 113 can be formed of a decoder circuit of a number of bits (AX0, /AX0, to AX7, /AX7) corresponding to a number of scanning lines, as shown in FIG. 10. The decoder circuit can be configured to receive the column scanning line driving circuit control signal 121 composed of an address signal, wherein the control signal 121 is decoded by a NAND gate circuit 113-7 formed of a CMOS transistor to select a corresponding column scanning line 112-m, and a selection signal can be output. This arrangement allows a selection signal to be output to an arbitrary scanning line according to an address signal, permitting pixels to be accessed at random.

By configuring the row scanning line driving circuit 111 by a decoder circuit similar to that showing in FIG. 10, when only partial display on a screen has to be rewritten, a liquid crystal pixel driving circuit for only a target pixel can be controlled to rewrite a data signal. In the present invention, each pixel is provided with the memory circuit 103, and unless the switching circuit 102 conducts by a selection signal of row and column scanning lines, the data signal written to the memory circuit 103 is retained. Hence, only the pixel to be rewritten can be accessed for rewriting.

As shown in FIG. 6, in this embodiment, the switching control circuit 109 can be configured by a logic circuit of a NOR gate circuit 109-1 formed of a CMOS transistor and an inverter 109-2 formed of a CMOS transistor. The NOR gate circuit 109-1 outputs an ON signal of the positive logic when selection signals of the negative logic are applied to two inputs thereof, and an ON signal of the negative logic is output by the inverter 109-2. Furthermore, the switching circuit 102 can be configured by a transmission gate 102-1 formed of a CMOS transistor. The transmission gate 102-1 is set to the conducting state based on the ON signal of the switching control circuit 109 to connect the column data line 115 and the memory circuit 103, whereas it is set to the nonconducting state based on the OFF signal. The memory circuit 103 can be configured so that a clocked inverter 103-1 formed of a CMOS transistor and an inverter 103-2 formed of a CMOS transistor are feedback-connected. The data signal is captured from the switching circuit 102 into the memory circuit 103 in response to an ON signal of the switching control circuit 109 and inverted by the inverter 103-2, and an output is fed back by a clocked inverter 103-1 operated by the OFF signal of the switching control circuit 109 so as to hold the data signal. The liquid crystal pixel driver 104 can be configured by transmission gates 104-1 and 104-2 formed of two CMOS transistors. If the data signal held at the memory circuit 103 is at the H-level, then the transmission gate 104-1, which is connected to the first voltage signal line 118 that causes a liquid crystal to provide the black display in the case of the normally white display mode, is set to a conducting state in the liquid crystal pixel driver 104, and the first voltage 116 is supplied to the pixel electrode 106, causing the liquid crystal pixel 105 to be set to the black display mode due to a potential difference from the reference voltage 122 supplied to the common electrode 108. Similarly, if the held data signal is at the L-level, then the transmission gate 104-2 connected to the second voltage signal line 119 is set to the conducting state, causing the second voltage 117 to be supplied to the pixel electrode 106, so that the liquid crystal-pixel 105 set to in the white display mode.

In this embodiment, the two bits of simultaneous input data signals are used, however, the number of bits is not limited thereto. For example, three bits of the simultaneous input data signal may be used in order to simultaneously input data signals for three colors, RGB, for performing color display.

[Fourth Embodiment]

Figure 7:
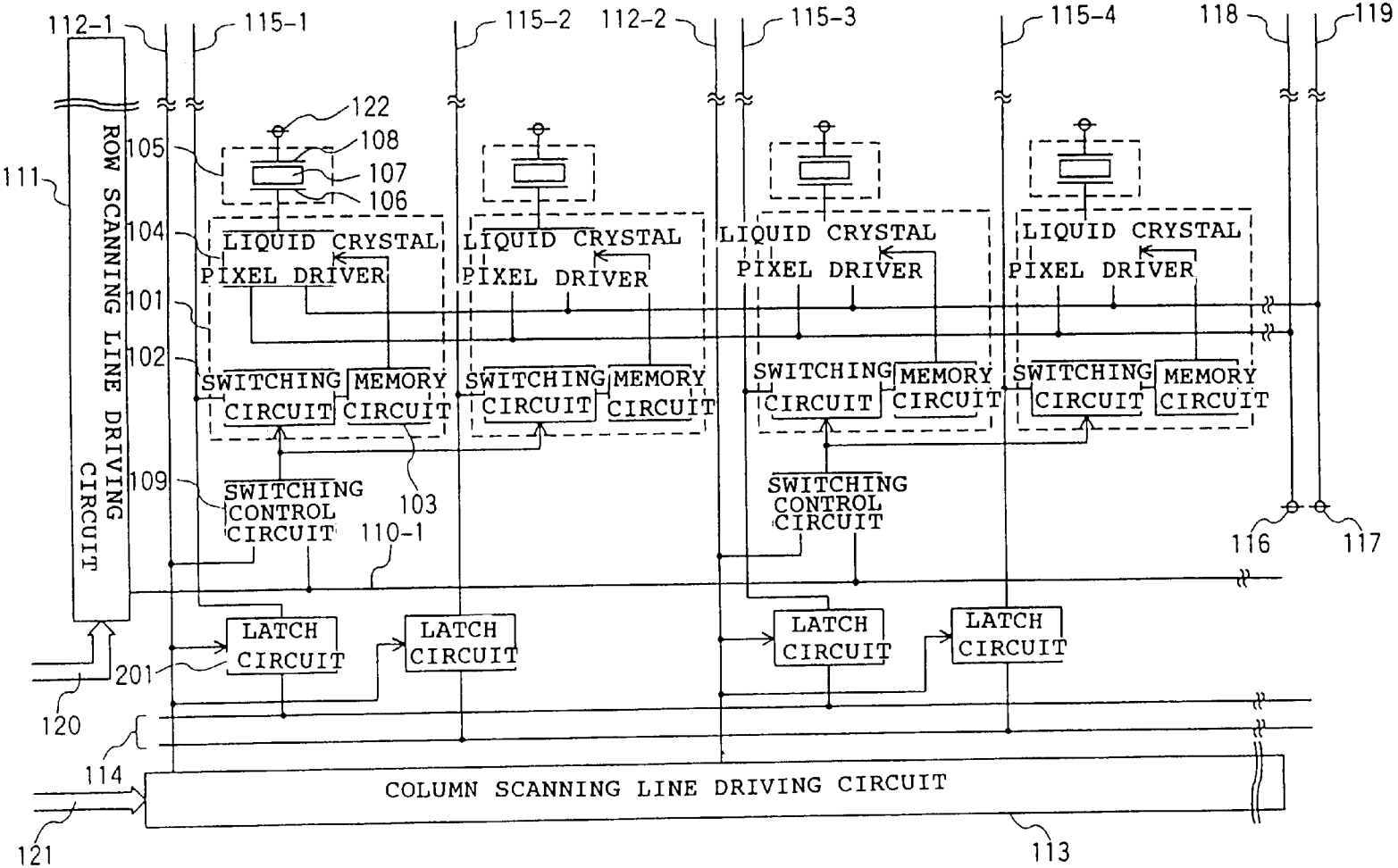
FIG. 7 is a block diagram showing essential sections of pixels and driving circuits or the like thereof in an electro-optic device based on a fourth embodiment in accordance with the present invention.
Figure 8:
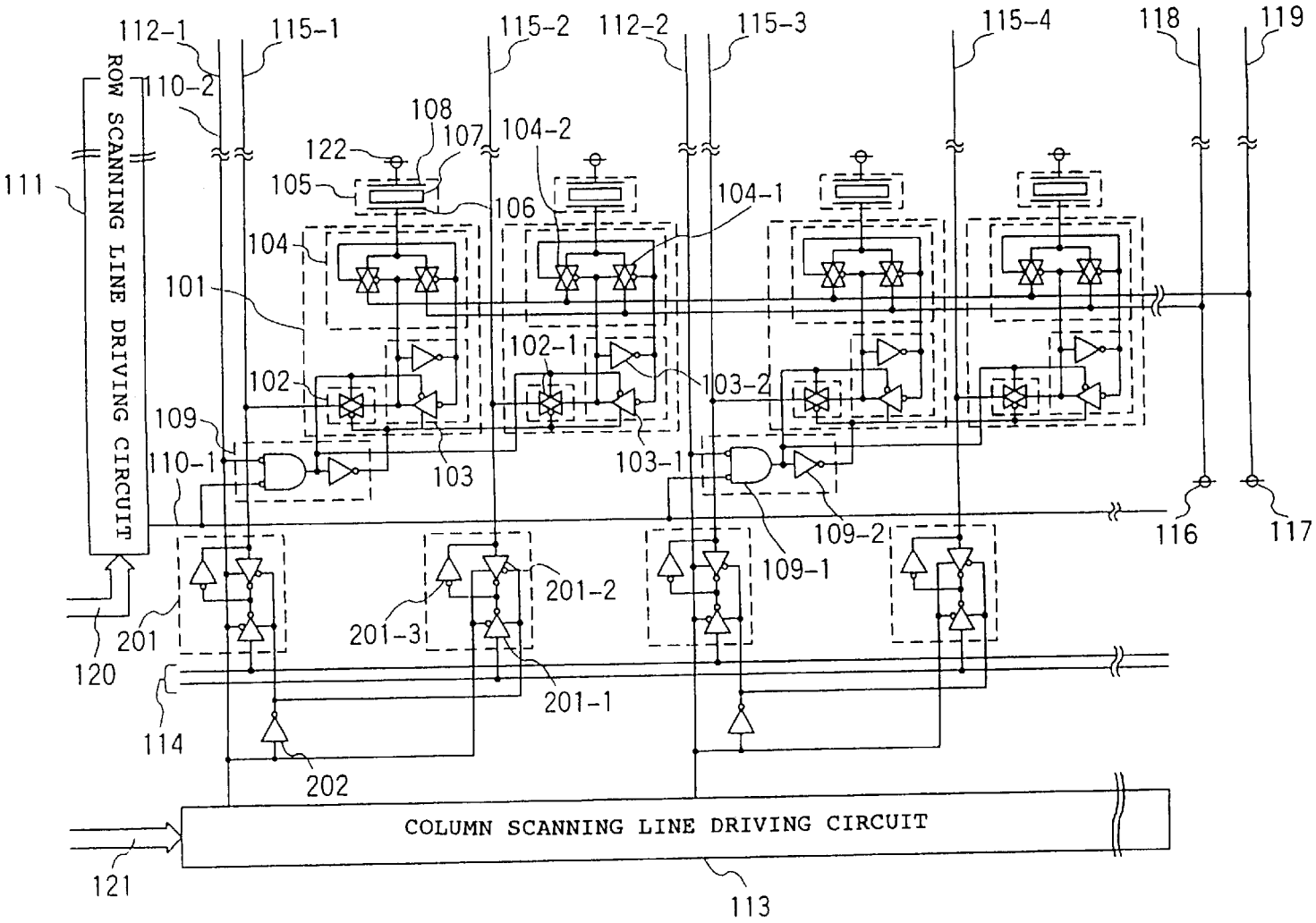
FIG. 8 is a circuit diagram showing a driving circuit of the electro-optic device based on the fourth embodiment in accordance with the present invention, the driving circuit being constituted by a CMOS transistor.

FIG. 7 is a block diagram showing essential sections of pixels and driving circuits or the like in a liquid crystal device that is an electro-optic device of a fourth embodiment in accordance with the present invention, and FIG. 8 is a detailed circuit diagram thereof.

As shown in FIG. 7, this embodiment is configured by adding a latch circuit 201, which is disposed at a point where a column data line 115 is branched from an input data line 114, to the block diagram of FIG. 5 shown in conjunction with the third embodiment. In this embodiment, configurations not explained in particular are identical to those of the third embodiment.

When the latch circuit 201 captures a data signal from the input data line 114 into a corresponding column data line 115-d when a column scanning line 112-m is selected, or holds the data signal of the column data line 115-d when the column scanning line 112-m is not selected.

According to this configuration, a capacitance parasitic to the input data line 114 can be reduced to only a capacitance of the column data line 115 connected to the selected latch circuit 201, permitting a marked reduction in power consumption to be achieved.

As illustrated in FIG. 8, this embodiment is constituted by adding the latch circuit 201 to the circuit diagram of FIG. 6 shown in conjunction with the third embodiment. The latch circuit 201 can be constituted by a logic circuit composed of clocked inverters 201-1 and 201-2 formed of CMOS transistors, and an inverter 201-3 formed of a CMOS transistor. A selection signal of the column scanning line 112-m, together with a signal that has been inverted by an inverter 202 formed of a CMOS transistor, is used as a signal for controlling the latch circuit 201. The data signal received from the input data line 114 is captured by the clocked inverter 201-1 in the first stage at a fall of a selection signal of the column scanning line 112-m , inverted by an inverter 201-3, and an output is fed back by the clocked inverter 201-2 at a rise of a selection signal of the column scanning line 112-m to perform an operation for holding the data signal.

In this embodiment, the two bits of simultaneous input data signals are used, however, the number of bits is not limited thereto. For example, three bits of the simultaneous input data signal may be used in order to simultaneously input data signals for three colors, RGB, for performing color display.

[Fifth Embodiment]

Figure 11:
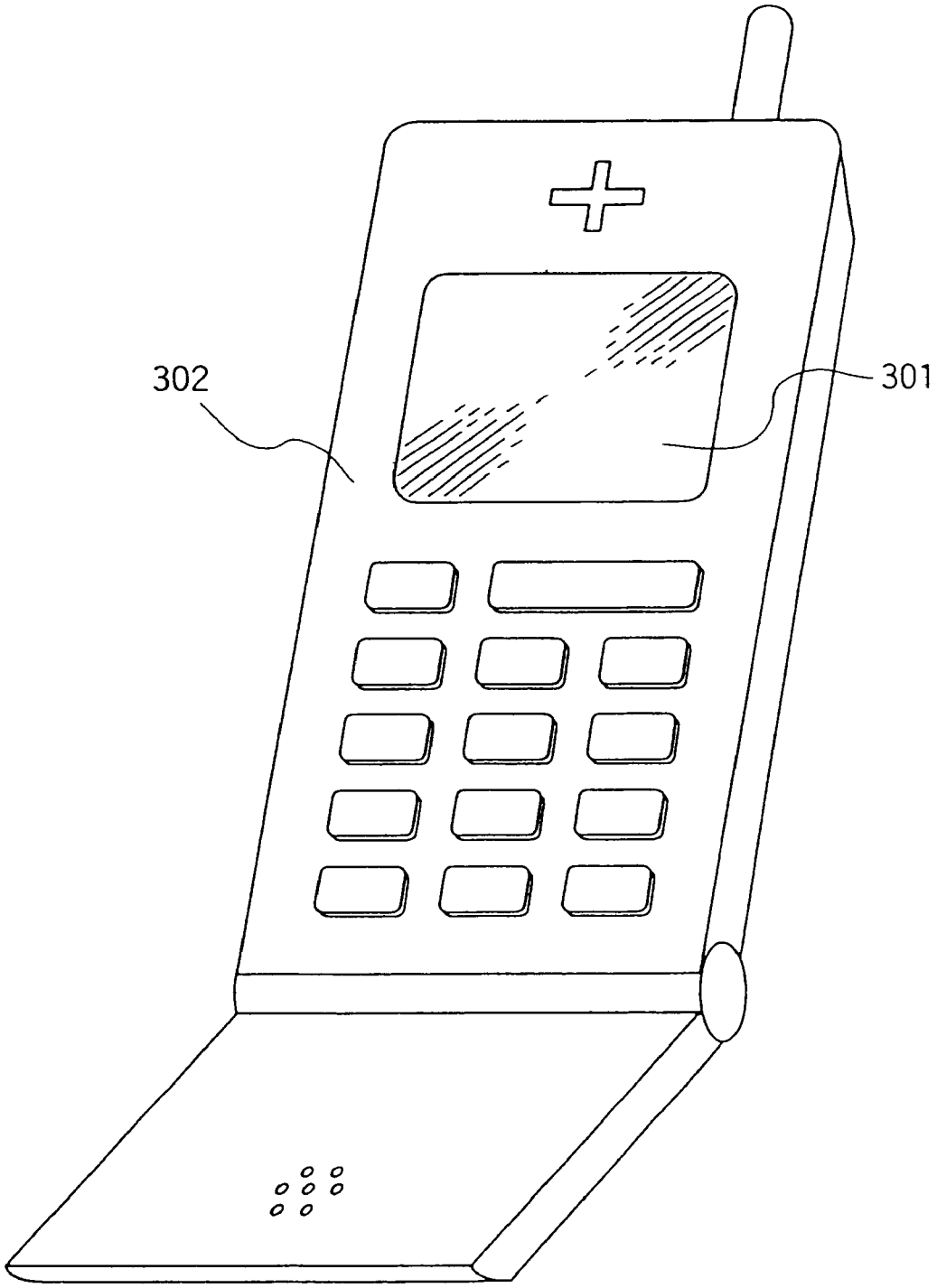
FIG. 11 is a diagram showing an electronic equipment based on a fifth embodiment in accordance with the present invention.
Figure 12:
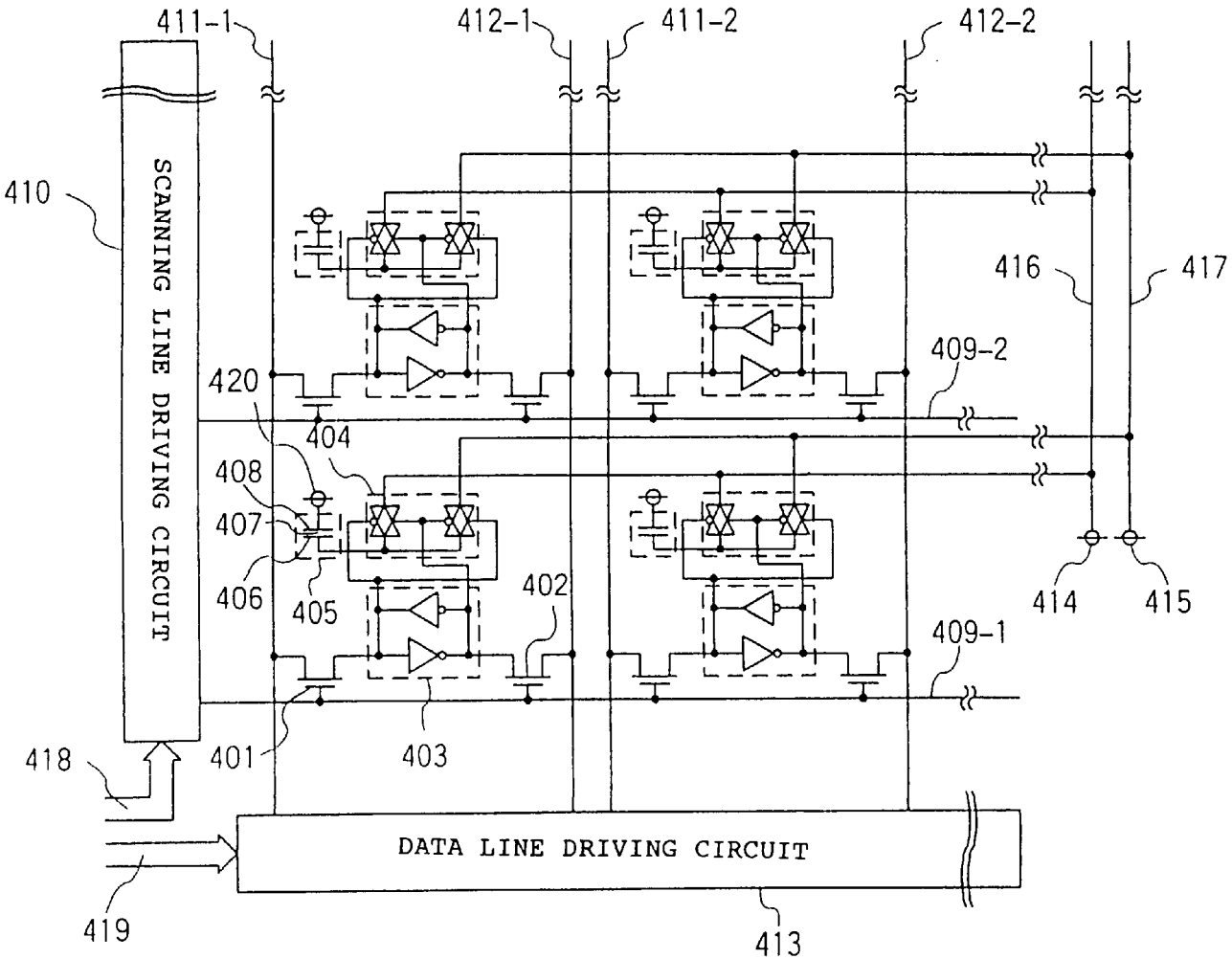
FIG. 12 is a diagram showing a conventional static drive liquid crystal device.

FIG. 11 shows an example wherein the electro-optic device of the present invention according to the first to fourth embodiments described above has been applied to a portable telephone. The liquid crystal device in accordance with the present invention is used as a display unit 301 of a portable telephone 302.

With the foregoing arrangement, a considerably prolonged service life can be achieved, as compared with electronic equipment using a conventional passive matrix liquid crystal device in a battery-driven mode. In addition, a simpler control method and a simpler control circuit configuration can be accomplished, as compared with a conventional static drive liquid crystal device.

In this embodiment, the portable telephone has been taken as an example, however, the application is not limited thereto. For instance, the electro-optic device in accordance with the present invention can be also applied to various types of electronic equipment, such as timepieces, pagers, and projectors. In the case of a projector, the electro-optic device in accordance with the present invention will be used as an optical modulator.

The electro-optic device in accordance with the present invention is not limited to the above embodiments, and various changes and modifications can be made within the gist or spirit that can be understood by reading the entire description of the invention. Electro-optic devices with such modifications are intended to be embraced in the technological scope of the present invention.

For example, in the embodiments, the descriptions have been given using liquid crystal devices as the electro-optic devices. However, the present invention can be also applied to electro-optic devices in which liquid crystal pixels have been replaced by other electro-optic members. Electro-optic devices other than liquid crystal devices include a digital micro-mirror device (DMD) in which a mirror is disposed for each pixel and an angle of the mirror is changed according to an image signal, and self-emissive display devices provided with a luminescent element for each pixel, such as a plasma display panel (PDP), a field emission display (FED), and electroluminescence (EL). These electro-optic devices may be of a type constructed only by a single substrate on which a pixel circuit has been formed or a type that uses a glass substrate rather than a semiconductor substrate, however, the present invention can be also applied to such structures.

What is claimed is:

1. An electro-optic device that displays by driving a plurality of electro-optic elements arranged in matrix, the electro-optic device comprising:

a plurality of first scanning lines, each first scanning line being used for supplying a first scanning signal used for simultaneous selection of a plurality of drivers arranged therealong, each driver controlling a display of an electro-optic element corresponding thereto;

a plurality of second scanning lines, each second scanning line being used for supplying a second scanning signal used for selection of one driver of the drivers simultaneously selected by the first scanning signal;

a plurality of first data lines, each first data line being used for supplying drivers arranged therealong with a data signal that is supplied via a second data line and that defines an ON-or-OFF state the one element thereof should display;

a voltage line being used for supplying electro-optic elements with a voltage corresponding to the ON-or-OFF state defined by the data signal;

a plurality of memory circuits included in the plurality of drivers, each memory circuit selectively reading the data signal of the first data lines and holding the read data signal;

a plurality of switching circuits included in the plurality of drivers, each switching circuit permitting a memory circuit of the plurality of memory circuits to read the data signal of the first data line when a first scanning signal is supplied to a first scanning line connected thereto and a second scanning signal is supplied to a second scanning line connected thereto, and to hold the data signal read of the first data line when one of the first and second scanning signals is not supplied to the first or second scanning lines; and a plurality of a driving circuits included in the plurality of drivers, each driving circuit supplying an electro-optic element of the plurality of electro-optic elements with a voltage corresponding to the ON-or-OFF state defined by the data signal held by the memory circuit, from the voltage line.

2. An electro-optic device as set forth in claim 1, further comprising a plurality of latching circuits, each latching circuit being connected to one of the plurality of second scanning lines, one of the plurality of first data lines, and the second data line, each latching circuit reading the data signal of the second data line when a second scanning signal is supplied to the one second scanning line and holding the data signal read of the second data line for the one first data line when a second scanning signal is not supplied thereto.

3. An electro-optic device as set forth in claim 1, wherein each memory circuit includes a clocked-inverter and an inverter.

4. An electronic equipment comprising the electro-optic device of claim 1.

* * * * *